United States Patent [19]

Sato et al.

[11] Patent Number: 4,590,152

[45] Date of Patent: May 20, 1986

[54] HEAT-DEVELOPABLE COLOR LIGHT-SENSITIVE MATERIAL

[75] Inventors: Kozo Sato; Hideki Naito, both of Kanagawa, Japan

[73] Assignee: Fuji Photo Film Co., Ltd., Kanagawa, Japan

[21] Appl. No.: 752,701

[22] Filed: Jul. 8, 1985

[30] Foreign Application Priority Data

Jul. 6, 1984 [JP] Japan ..... 59-140239

[51] Int. Cl.[4] ..... G03C 7/26

[52] U.S. Cl. ..... 430/543; 430/351; 430/552; 430/553; 430/554; 430/555; 430/556; 430/557; 430/558; 430/566

[58] Field of Search ..... 430/566, 553, 351, 543, 430/552–558

[56] References Cited

U.S. PATENT DOCUMENTS

| | | | |
|---|---|---|---|
| 4,039,520 | 8/1977 | Habu et al. | 430/626 |
| 4,423,126 | 12/1983 | Klijanowicz et al. | 430/566 |
| 4,426,441 | 1/1984 | Adin et al. | 430/566 |

*Primary Examiner*—Mary F. Downey
*Attorney, Agent, or Firm*—Sughrue, Mion, Zinn, Macpeak & Seas

[57] ABSTRACT

A heat-developable color light-sensitive material comprising a support having thereon at least: (1) a light-sensitive silver-halide, (2) a coupler capable of coupling with an oxidation product of a developing agent, (3) a hydrophilic binder, and (4) at least one compound represented by the following general formula (Z):

(Z)

the substituents A, $R_1$, $R_2$, $R_3$, $R_4$, X and $R_5$ are defined herein.

The heat-developable color light-sensitive material containing the developing agent or the precursor thereof represented by the general formula (Z) which is excellent in stability during storage, silver developing property and coupling property has good preservability and can provide color images having a high S/N ratio and a high image density.

16 Claims, No Drawings

HEAT-DEVELOPABLE COLOR LIGHT-SENSITIVE MATERIAL

FIELD OF THE INVENTION

The present invention relates to a heat-developable color light-sensitive material, and more particularly to a heat-developable color light-sensitive material containing a developing agent or a precursor thereof which has remarkably good preservability and provides color images having a high image density and a low fog density.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for light-sensitive materials using silver halide, many techniques cable of easily and quickly obtaining images have been developed by changing the conventional wet process using a developing solution into a dry development process such as a process using heat, etc.

Heat-developable light-sensitive materials are known in the field of these techniques. Heat- developable light-sensitive materials and processes therefor have been described, for example, in U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

Many different processes for obtaining color images have been proposed. With respect to processes for forming color images by the coupling of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (September, 1975) and the combination of a sulfonamidophenol type reducing agent and a 4-equivalent coupler as described in U.S. Pat. No. 4,021,240.

Further, a process in which a diffusible dye is released upon the coupling of an oxidation product of a developing agent with a coupler is described in Japanese Patent Application (OPI) No. 79247/83, etc.

However, such developing agents which are employed in these known heat-developable color light-sensitive materials, for example, p-phenylenediamines or p-aminophenols are inferior in their preservability and cause remarkable coloration in non-image areas. On the other hand, p-sulfonamidophenols have a poor silver developing property and coupling property and can not provide color images of high density, although they have improved preservability.

Moreover, hydrazone derivatives as described in *Research Disclosure,* No. 19417 (June, 1980) have a poor coupling property and can only provide color images of low density. Furthermore, sulfamic acid salts as described in Japanese Patent Application (OPI) No. 146133/81, urea derivatives as described in U.S. Pat. No. 4,426,441, or urea derivatives as described in Japanese Patent Application (OPI) No. 53831/84, etc. are compounds in which p-phenylenediamines or p-aminophenols are stabilized by means of protective groups. However, these compounds also have a poor silver developing property and only provide color images of low density.

SUMMARY OF THE INVENTION

Therefore, an object of the present invention is to provide a heat-developable color light-sensitive material which has good preservability and can provide color images having high image density and a high S/N ratio.

Another object of the present invention is to provide a developing agent suitable for use in a heat-developable color light-sensitive material which is excellent in stability during storage, silver developing properties and coupling properties.

These and other objects of the present invention will become more apparent from the following detailed description and examples.

These objects of the present invention are accomplished by using, as a developing agent, a compound represented by the general formula (Z).

More specifically, the objects of the present invention are accomplished with a heat-developable color light-sensitive material comprising a support having thereon at least: (1) a light-sensitive silver halide, (2) a coupler capable of coupling with an oxidation product of a developing agent, (3) a hydrophilic binder, and (4) at least one compound represented by the following general formula (Z):

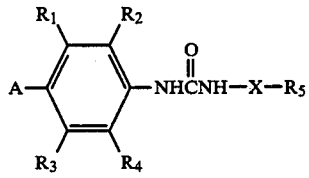

(Z)

wherein $R_1$, $R_2$, $R_3$ and $R_4$ each independently represents a hydrogen atom, a halogen atom, an alkyl group, an alkenyl group, a cycloalkyl group, an aralkyl group, a hydroxy group, an amino group, a substituted amino group, an alkoxy group, an acylamino group, an alkylsulfonylamino group, an arylsulfonylamino group, an aryl group, a carbamoyl group, a substituted carbamoyl group, a sulfamoyl group, a substituted sulfamoyl group, an acyl group, an acyloxy group or an alkoxycarbonyl group, or $R_1$ and $R_2$ or $R_3$ and $R_4$ are connected to each other to form a ring; A represents a hydroxy group, a group capable of providing a hydroxy group upon the function of a nucleophilic reagent or a group of

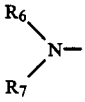

(wherein $R_6$ and $R_7$ each represents a hydrogen atom, a substituted or unsubstituted alkyl group, a substituted or unsubstituted alkenyl group, a substituted or unsubstituted cycloalkyl group or a substituted or unsubstituted aralkyl group, or $R_6$ and $R_7$ are connected to each other to form a hetero ring), or when A represents the group of

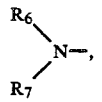

$R_1$ and $R_6$ and/or $R_3$ and $R_7$ are connected to each other to form a hetero ring; $R_5$ represents a substituted or unsubstituted alkyl group, a substituted or unsubstituted alkenyl group, a substituted or unsubstituted cycloalkyl group, a substituted or unsubstituted aralkyl group or a substituted or unsubstituted aryl group; and X represents a group of

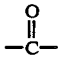

or a group of $—SO_2—$,

DETAILED DESCRIPTION OF THE INVENTION

The compounds represented by the general formula (Z) used in the present invention are described in detail below.

In the general formula (Z), $R_1$, $R_2$, $R_3$ and $R_4$ each independently represents a hydrogen atom, a halogen atom (e.g., a chlorine atom, a bromine atom, etc.), an alkyl group preferably having from 1 to 32 carbon atoms (e.g., a methyl group, an ethyl group, an octyl group, etc.), an alkenyl group preferably having from 2 to 32 carbon atoms (e.g., a vinyl group, etc.), a cycloalkyl group preferably having from 3 to 8 carbon atoms (e.g., a cyclohexyl group, etc.), an aralkyl group preferably having from 7 to 38 carbon atoms (e.g., a benzyl group, a phenylethyl group, etc.), a hydroxy group, an amino group, a substituted amino group, an alkoxy group preferably having from 1 to 32 carbon atoms (e.g., a methoxy group, an ethoxy group, etc.), an acylamino group preferably having from 2 to 33 carbon atoms (e.g., an acetylamino group, a butyrylamino group, a caprylamino group, a stearoylamino group, etc.), an alkylsulfonylamino group preferably having from 1 to 32 carbon atoms (e.g., a methylsulfonylamino group, etc.), an arylsulfonylamino group (e.g., a phenylsulfonylamino group, etc.), an aryl group (e.g., a phenyl group, a naphthyl group, etc.), a carbamoyl group, a substituted carbamoyl group (e.g., a methylcarbamoyl group, a dimethylcarbamoyl group, an ethylcarbamoyl group, etc.), a sulfamoyl group, a substituted sulfamoyl group (e.g., a methylsulfamoyl group, an ethylsulfamoyl group, etc.), an acyl group preferably having from 2 to 33 carbon atoms (e.g., an acetyl group, etc.), an acyloxy group preferably having from 2 to 33 carbon atoms (e.g., an acetyloxy group, etc.) or an alkoxycarbonyl group preferably having from 2 to 33 carbon atoms (e.g., a methoxycarbonyl group, an ethoxycarbonyl group, etc.), or $R_1$ and $R_2$ or $R_3$ and $R_4$ are connected to each other to form a ring (e.g., a 5- or 6-membered nitrogen-containing heterocyclic ring).

In the general formula (Z), when $R_1$, $R_2$, $R_3$ or $R_4$ represents an aliphatic hydrocarbon group such as an alkyl group or an alkenyl group, etc., the aliphatic hydrocarbon group may have from 1 to 32 carbon atoms and may be a straight chain or branched chain. The cycloalkyl group may have from 3 to 8 carbon atoms. These aliphatic groups may have one or more substituents including substituting atoms (hereinafter referred to as substituents). Examples of the substituents are described below as substituents for the group represented by $R_1$. When two or more substituents are present, they may be the same or different. The aryl group represented by $R_1$, $R_2$, $R_3$ or $R_4$ includes typically a phenyl group and a naphthyl group and each of these groups may be substituted with one or more substituents as described for the aliphatic group above.

Examples of the substituents for the group represented by $R_1$, $R_2$, $R_3$ or $R_4$ include an aliphatic group (e.g., a methyl group, an ethyl group, etc.), an aryl group (e.g., a phenyl group, etc.), a heterocyclic group (e.g., a 5- or 6-membered heterocyclic ring containing a nitrogen atom, a sulfur atom or an oxygen atom, etc.), an aliphatic oxy group (e.g., a methoxy group, etc.), an aromatic oxy group (e.g., a phenoxy group, etc.), an acyl group (e.g., an acetyl group, etc.), an ester group, an amido group, an imido group, an aliphatic, aryl or heterocyclic sulfonyl group (e.g., a methylsulfonyl group, a phenylsulfonyl group, a 5- or 6-membered heterocyclic sulfonyl group containing a nitrogen atom, a sulfur atom or an oxygen atom), an aliphatic, aryl or heterocyclic thio group (e.g., a methylthio group, a phenylthio group, a 5- or 6-membered heterocyclic thio group containing a nitrogen atom, a sulfur atom or an oxygen atom), a hydroxy group, a cyano group, a carboxy group, a sulfo group and a nitro group, etc.

Substituents for the substituted amino group, the substituted carbamoyl group or the substituted sulfamoyl group represented by $R_1$, $R_2$, $R_3$ or $R_4$ are the same as those substituents described for $R_1$, $R_2$, $R_3$ or $R_4$.

A represents a hydroxy group, a precursor thereof or a group of

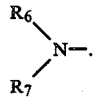

The precursor of a hydroxy group means a group capable of providing a hydroxy group upon the function of a nucleophilic reagent. The nucleophilic reagent includes an anionic reagent such as $OH^-$, $OR^-$, $SO_3^{2-}$, etc., and a compound having a lone pair of electrons such as a primary or secondary amine, a hydrazine, a hydroxylamine, an alcohol, a thiol, etc.

Preferred examples of A include a hydroxy group, an acyloxy group, an alkylsulfonyloxy group, an arylsulfonyloxy group, an alkoxycarbonyloxy group, an aryloxycarbonyloxy group, a dialkylphosphoryloxy group, a diarylphosphoryloxy group, a dialkylamino group (the alkyl groups may be substituted), a pyrrolidino group, a piperidino group or a morpholino group, etc.

Preferred examples of $R_1$, $R_2$, $R_3$ or $R_4$ include a hydrogen atom, a halogen atom, an alkyl group, an alkoxy group, an acylamino group, an aryl group, a carbamoyl group or a substituted carbamoyl group, etc.

Preferred examples of $R_5$ include an alkyl group (e.g., a methyl group, etc.), a cycloalkyl group, an aralkyl group (e.g., a benzyl group, etc.) and an aryl group (e.g., a phenyl group, etc.), etc., each of these groups may be substituted with one or more substituents as described for $R_1$.

Preferred examples of the developing agents represented by the general formula (Z) above according to the present invention are specifically set forth below, but the present invention should not be construed as being limited to these compounds.
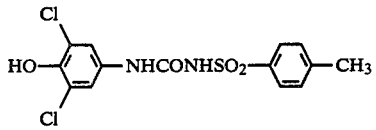
No. 1
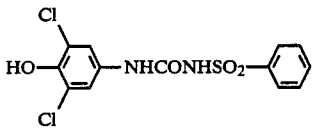
No. 2
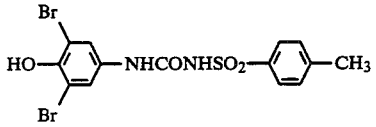
No. 3
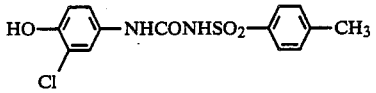
No. 4
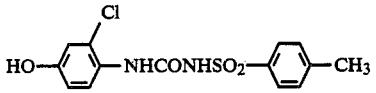
No. 5
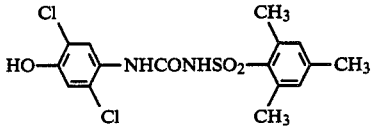
No. 6
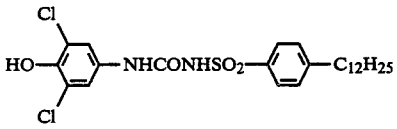
No. 7
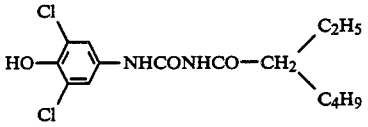
No. 8
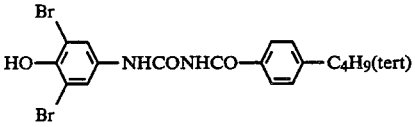
No. 9
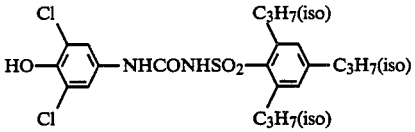
No. 10
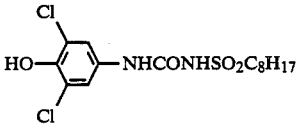
No. 11
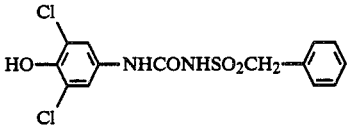
No. 12
-continued
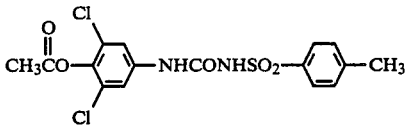
No. 13
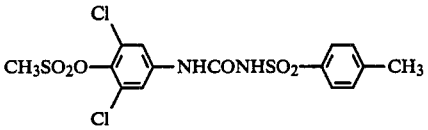
No. 14
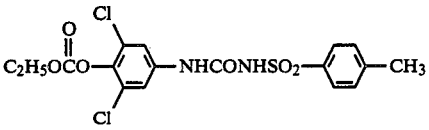
No. 15
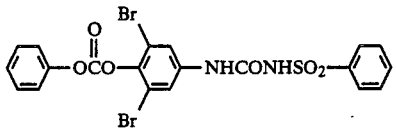
No. 16
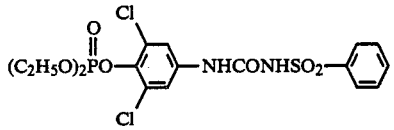
No. 17
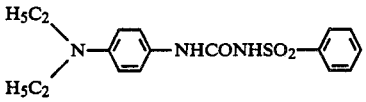
No. 18
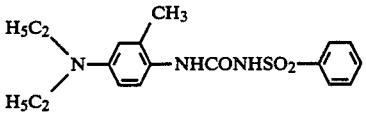
No. 19
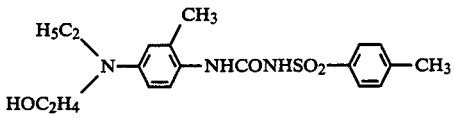
No. 20
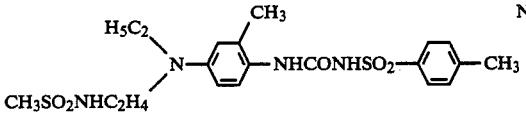
No. 21
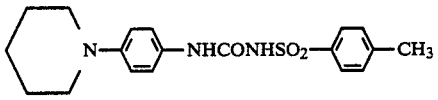
No. 22
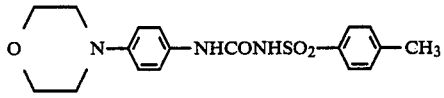
No. 23
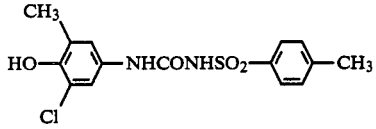
No. 24

-continued

No. 25

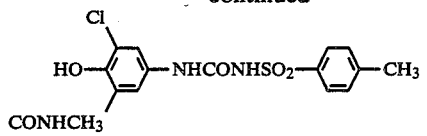

No. 26

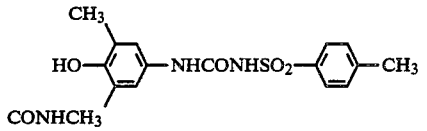

No. 27

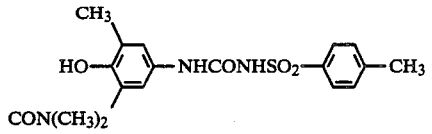

No. 28

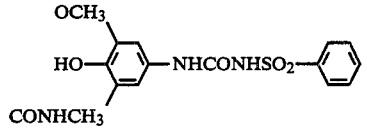

No. 29

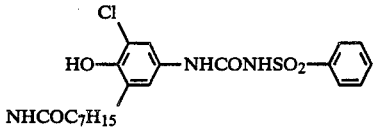

No. 30

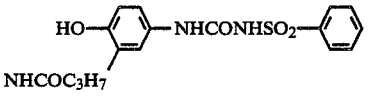

No. 31

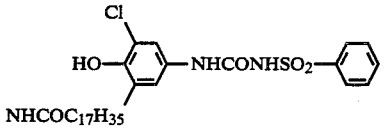

No. 32

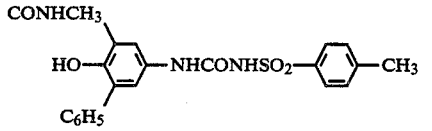

No. 33

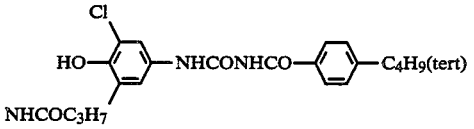

No. 34

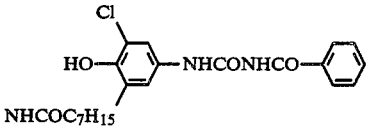

No. 35

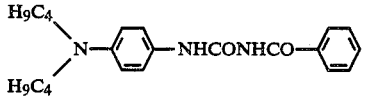

No. 36

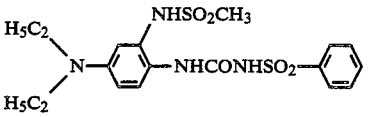

The developing agents represented by the general formula (Z) and used in the present invention can be obtained by known methods, for example, reaction of a sulfonyl (or acyl) isocyanate prepared by a method as described in *Shin-Jikken Kagaku Koza,* Vol. 14 (III), pages 1491 to 1497 (Maruzen, 1978) with a corresponding amine.

A synthesis example of the developing agent used in the present invention is specifically described below.

SYNTHESIS EXAMPLE

Synthesis of Compound No. 1

17.8 g (0.1 mol) of 2,6-dichloro-4-aminophenol was dissolved in 100 ml of ethyl acetate and to the solution was added dropwise 20.7 g (0.105 mol) of p-toluenesulfonylisocyanate while cooling with ice. After the completion of the dropwise addition, the mixture was stirred for 30 minutes at room temperature. The ethyl acetate was distilled off under a reduced pressure until about a half of the original volume and to the residue was added 50 ml of n-hexane. The white crystals thus-precipitated were collected by filtration and washed with a solvent mixture of ethyl acetate and hexane (1:1). Yield : 29.8 g. Melting Point : 197°to 200° C.

In a similar manner to the above, other developing agents can be synthesized. Examples of the developing agents synthesized are shown in the following table.

| Compound No. | Melting Point (°C.) |
|---|---|
| 2 | 190 to 193 |
| 3 | 210 to 212 |
| 4 | 189 to 193 |
| 5 | 187 to 190 |

Various kinds of couplers capable of coupling with an oxidation product of a developing agent are known. For example, any of the couplers described in T. H. James, *The Theory of the Photographic Process,* 4th Ed., pages 354 to 361, and Shinichi Kikuchi, *ShashinKagaku,* 4th Ed., pages 284 to 295 (Kyoritsu Shuppan), etc. can be utilized in the present invention.

In the present invention, both 4-equivalent couplers in which a hydrogen atom is attached to the position at which the coupler is connected to an oxidation product of a developing agent and 2-equivalent couplers in which the coupling position is substituted with a releasing group can be employed. Further, not only so-called Fischer dispersion type couplers which have a hydrophillic group as well as a hydrophobic diffusion-resistant group in their molecules, but also so-called oil-protected dispersion type couplers which have only a hydrophobic diffusion-resistant group can be employed.

Couplers having a diffusion-resistant group include couplers having a hydrophobic ballast group in their releasing groups as described in Japanese Patent Application (OPI) No. 149046/83, etc.; couplers in which the releasing groups are connected to a main chain of a polymer as described in Japanese Patent Application (OPI) No. 149047/83, etc.; and polymer couplers as described in U.S. Pat. Nos. 3,370,952, 3,451,820, 4,080,211, 4,215,195 and 4,409,320, etc.

Furthermore, colored couplers which contain a dye portion in their releasing groups such as those described in British Patent 1,330,524, Japanese Patent Publication No. 39165/73, Japanese Patent Application (OPI) Nos. 186744/82, 207250/82 and 79247/83, etc. are useful in the present invention.

Preferred couplers which can be used in the present invention include active methylene compounds, active methine compounds, phenols, naphthols, pyrazole compounds and condensed pyrazole compounds.

Particularly preferred couplers use can be represented by the following general formulae (I) to (X):

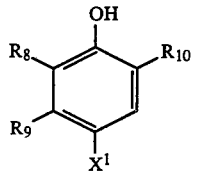

(I)

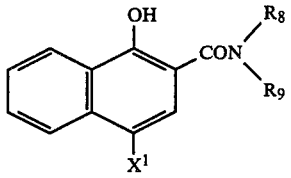

(II)

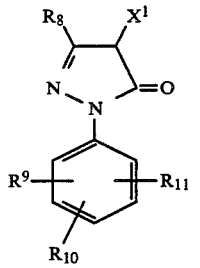

(III)

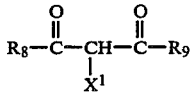

(IV)

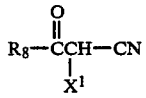

(V)

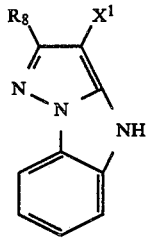

(VI)

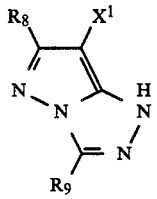

(VII)

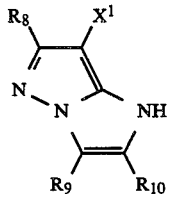

(VIII)

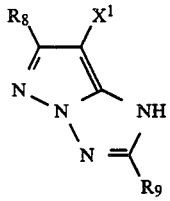

(IX)

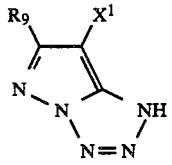

(X)

wherein $R_8$, $R_9$, $R_{10}$ and $R_{11}$ each represents a substituent selected from a hydrogen atom, a halogen atom, an alkyl group, a cycloalkyl group, an aralkyl group, an alkenyl group, an aryl group, an alkoxy group, an aryloxy group, an acyl group, an acylamino group, an alkoxyalkyl group, an aryloxyalkyl group, a carbamoyl group, a substituted carbamoyl group, a sulfamoyl group, a substituted sulfamoyl group, an alkylamino group, an arylamino group, an acyloxy group, an acyloxyalkyl group, a substituted ureido group, a cyano group and a heterocyclic group and, these substituents may further be substituted with an alkyl group, an alkoxy group, a halogen atom, a hydroxy group, a carboxy group, a sulfo group, a cyano group, a nitro group, a carbamoyl group, a substituted carbamoyl group, a sulfamoyl group, a substituted sulfamoyl group, an acylamino group, an alkylsulfonylamino group, an arylsulfonylamino group, an aryl group, an aryloxy group, an aralkyl group or an acyl group; and $X^1$ represents a hydrogen atom or a coupling releasing group.

Representative examples of the coupling releasing groups include a halogen atom, an acyloxy group, a sulfonyloxy group, an alkoxy group, an aryloxy group, an alkylthio group, an arylthio group, an alkoxycarbonyloxy group, a dialkylcarbamoyloxy group, an amido group, an N-heterocyclic group or a pyridinium group, etc.

It is preferred that any one of $R_8$, $R_9$, $R_{10}$, $R_{11}$ and $X^1$ includes a ballast group (having at least 6 carbon atoms) in order to render the coupler diffusion-resistant. Alternatively, any one of $R_8$, $R_9$, $R_{10}$, $R_{11}$ and $X^1$ may be connected to a main chain of a polymer.

Diffusion-resistant compounds capable of releasing a diffusible dye upon the coupling reaction with an oxidation product of a developing agent, i.e., dye-releasing couplers can also be employed in the present invention. Typical examples of such compounds are those described in U.S. Pat. No. 3,227,550. Suitable examples thereof are representd by the following general formula (XI):

$$\text{Coup—Link—Dye} \qquad \text{(XI)}$$

wherein Coup represents a coupler residue capable of coupling with an oxidation product of a developing agent; Link is connected to the active point of the coupler residue and represents a group having a bond connected to the coupler residue which bond is capable of being cleaved when the dye providing substance represented by the general formula (XI) is subjected to the coupling reaction with an oxidation product of a developing agent; and Dye represents a dye portion.

In the above described general formula (XI), preferred coupler residues represented by Coup are the residues formed by eliminating $X^1$ from the couplers represented by the above described general formulae (I) to (X).

Suitable examples of Link include an azo group, an azoxy group, —O—, —Hg—, an alkylidene group, —S—, —S-S— or —$NHSO_2$—, etc. Also, the above described coupling releasing groups represented by $X^1$ are useful.

Preferred compounds of the dye-releasing couplers represented by (XI) described above are those wherein Coup represents a phenol type coupler residue, a naphthol type coupler residue or an indanone type coupler residue and Link is connected to Coup through an oxygen atom or a nitrogen atom.

The above described developing agents or precursors thereof represented by the general formula (Z) according to the present invention can be used either individually or in a combination two or more thereof. They can be generally employed in a range of about 0.1 mol to about 10 mols per mol of the silver salt constituting the light-sensitive layer, and preferably from about 0.2 mol to about 3 mols per mol of the silver salt.

The developing agents or precursors thereof according to the present invention may be incorporated into light-sensitive materials in various manners. According to a method which is conventionally known as the oil protect method, they are dissolved in a hydrophobic oil and then the solution is emulsified or dispersed in water or a hydrophilic colloid solution to prepare an oil-in-water type dispersion. Also, they can be dissolved in a water-miscible solvent and then the solution is added to water or a hydrophilic colloid solution in the form of fine particles. Further, the solid compounds can be introduced into water or a hydrophilic binder using a ball mill, etc.

In the present invention, an amount of the coupler added is from 0.001 to 1 mol per mol of silver halide and more preferably from 0.01 to 0.5 mol per mol of silver halide.

The dye providing compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye providing compound is dispersed in a hydrophilic colloid after dissolved in an organic solvent having a high boiling point, for example, a phthalic acid alkyl ester (for example, dibutyl phthalate, dioctyl phthalate, etc.). a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing compound is dispersed in a hydrophilic colloid. For this purpose, the surface active agents illustrated in other part of the specification can be used.

In the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 $\mu$m to 10 $\mu$m and more preferably from 0.001 $\mu$m to 5 $\mu$m.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a ilver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1 H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

In the present invention, it is particularly preferred to use various bases or base precursors as dye releasing assistants.

The bases or precursors thereof can be used in a light-sensitive material and/or a dye fixing material. In the case of incorporating them in a light-sensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or organic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

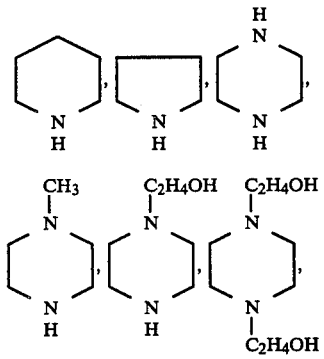

-continued

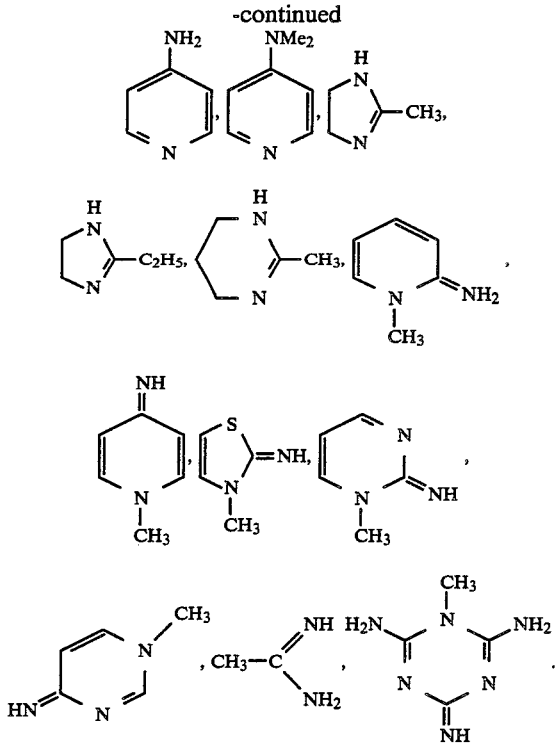

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc., are effective.

Further, amineimides as described in *Research Disclosure,* No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the light-sensitive material, and, preferably, a range of from 0.01% by weight to 40% by weight.

The above described bases or base precursors can be used not only for the acceleration of dye release but also for other purposes such as the control of a pH value.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat developable color photographic material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardenrrs, mordants and so on, are those described in U.S. Pat. Nos. 4,500,626, 4,478,927, 4,463,079, and Japanese Patent Application Nos. 28928/83 (corresponding to U.S. patent application Ser. No. 582,655 filed on Feb. 23, 1984) and U.S. Pat. No. 4,503,137. Methods for the exposure and so on cited in the above described patents can be employed in the present invention also.

The present invention will be explained in greater detail with reference to the following examples, but the present invention should not be construed as being limited thereto.

Unless otherwise specified, all ratios, percents, etc., are by weight.

EXAMPLE 1

A method of preparing a silver iodobromide emulsion is described in the following.

40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above-prepared solution over 10 minutes. Then, a solution of 3.3 g of potassium iodide (KI) dissolved in 100 ml of water was added over 2 minutes. The thus-prepared silver iodobromide emulsion was adjusted in pH, precipitated, and freed of excess salts. It was then adjusted to pH 6.0, thereby 400 g of a silver iodobromide emulsion was obtained.

A method of preparing a silver benzotriazole emulsion is described in the following.

28 g of gelatin and 13.2 g of benzotriazole were dissolved in 3,000 ml of water and the solution was maintained at 40° C. with stirring. A solution of 17 g of silver nitrate dissolved in 100 ml of water was added to the above-prepared solution over 2 minutes. The thus-prepared silver benzotriazole emulsion was adjusted in pH, precipitated, and freed of excess salts. It was then adjusted to a pH of 6.0, thereby 400 g of a silver benzotriazole emulsion was obtained.

A method of preparing a gelatin dispersion of a coupler is described in the following.

A mixture of 10 g of 2-dodecylcarbamoyl-1-naphthol, 0.5 g of sodium 2-ethylhexyl sulfosuccinate, 5 g of tricresyl phosphate (TCP) and 20 ml of ethyl acetate was dissolved by heating. This solution was mixed with a 10% aqueous solution of gelatin with stirring and the mixture was dispersed by means of a highspeed shearing stirrer at 10,000 rpm for 10 minutes. The dispersion thus-obtained was designated a dispersion of coupler.

In the following, a method of preparing a light-sensitive material is described.

| | | |
|---|---|---|
| (a) | Silver iodobromide emulsion described above | 8 g |
| (b) | Silver benzotriazole emulsion described above | 4 g |
| (c) | 10% Aqueous solution of gelatin | 5 g |
| (d) | Dispersion of coupler described above | 3.5 g |
| (e) | 10% Aqueous solution of guanidine trichloroacetate | 2.2 ml |
| (f) | 10% Methanol solution of Compound (1) according to the present invention | 2 ml |
| (g) | 5% Aqueous solution of octaethylene-glycol nonylphenol ether | 5 ml |
| (h) | Water | 6 ml |

The above described components (a) to (h) were mixed and dissolved and the mixture was coated on a polyethylene terephthalate film at a wet layer thickness of 60 μm and then dried.

On the thus-formed layer, a solution having the following composition was coated at a wet layer thickness of 25 μm and dried to form a protective layer, whereby Light-Sensitive Material A was prepared.

| | | |
|---|---|---|
| (a') | 10% Aqueous solution of gelatin | 35 g |
| (b') | 10% Ethanol solution of guanidine trichloroacetate | 5 ml |
| (c') | 1% Aqueous solution of sodium 2-ethylhexyl sulfosuccinate | 4 ml |
| (d') | Water | 56 ml |

Light-Sensitive Materials B to E were prepared in the same manner as described for Light-Sensitive Material A except using Compounds (2) to (5) according to the present invention in place of Compound (1), respectively. Further, for comparison, Light-Sensitive Materials F and G were prepared in the same manner as described for Light-Sensitive Material A except using 4-amino-2,6-dichlorophenol and 4-(N,N-diethylamino)-2-methylaminophenol in place of Compound (1), respectively.

Light-Sensitive Materials A to G thus-obtained were each exposed imagewise at 2,000 lux for 10 seconds using a tungsten lamp and then heated for 30 seconds on a hot plate which had been heated at 130° C.

As a result, a negative cyan image was obtained on the film. The density of the negative cyan image was measured using a Macbeth transmittant densitometer (TD-504). The results thus-obtained are shown in Table 1 below.

Further, Light-Sensitive Materials A to G were each allowed to stand at room temperture (at 25° C.) for 1 week and then subjected to light exposure and development in the same manner as described above. The increase in fog density (A D min) was measured using the Macbeth densitometer and the results thus-obtained are also shown in Table 1 below.

TABLE 1

| Light-Sensitive Material | Compound | D max | D min | A D min (after lapse of 1 week at 25° C.) |
|---|---|---|---|---|
| A | Compound (1) (Present Invention) | 1.85 | 0.30 | 0.25 |
| B | Compound (2) (Present Invention) | 1.90 | 0.28 | 0.20 |
| C | Compound (3) (Present Invention) | 2.00 | 0.28 | 0.25 |
| D | Compound (4) (Present Invention) | 1.60 | 0.25 | 0.20 |
| E | Compound (5) (Present Invention) | 1.65 | 0.20 | 0.22 |
| F | Comparative Compound | 2.20 | 0.35 | 2.30 |
| G | Comparative Compound | 1.05 | 0.25 | 1.85 |

From the results shown in Table 1, it is apparent that the compounds for comparison used in Light-Sensitive Material F and G have remarkably adverse effects on the stability of the light-sensitive materials while a good ratio of D max/D min can be achieved. In contrast, the compounds according to the present invention are also excellent in stability during preservation.

EXAMPLE 2

Light-Sensitive Materials H and I were prepared in the same manner as described for Light-Sensitive Material A of Example 1 except using the same amount of the couplers described below in place of the coupler used in Light-Sensitive Material A, respectively.

Coupler for Light-Sensitive Material H:

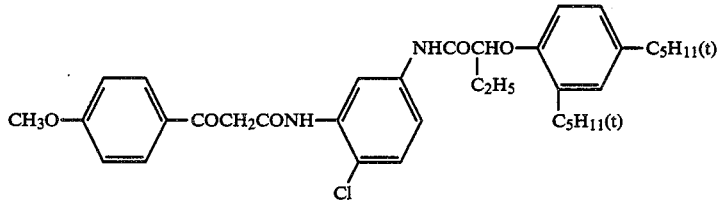

Coupler for Light-Sensitive Material I:

-continued

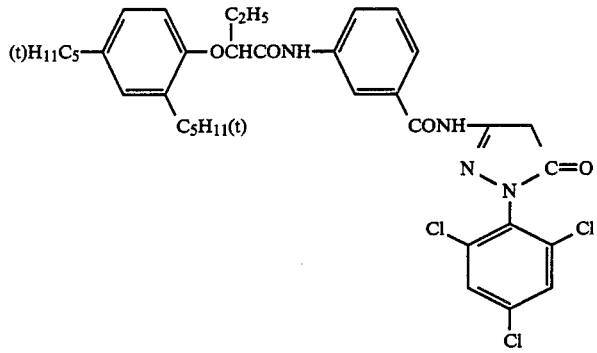

These light-sensitive materials were each exposed and developed in the same manner as described in Example 1 whereby a negative yellow image was obtained on Light-Sensitive Material H and a negative magenta image was obtained on Light-Sensitive Material I. The results thus-obtained are shown in Table 2 below.

TABLE 2

| Light-Sensitive Material | Compound | D max | D min | A D min (after lapse of 1 week at 25° C.) |
|---|---|---|---|---|
| H | Compound (1) (Present Invention) | 1.40 | 0.15 | 0.18 |
| I | Compound (1) (Present Invention) | 2.05 | 0.19 | 0.30 |

From the results shown in Table 2, it is apparent that the compound according to the present invention can also provide an excellent S/N ratio (D max/D min ratio) and be effective to obtain stable light-sensitive materials when using a yellow coupler or a magenta coupler instead of a cyan coupler.

EXAMPLE 3

A dispersion of a dye providing substance was prepared in the following manner instead of the dispersion of coupler as described in Example 1.

A mixture of 10 g of a dye providing substance shown below, 0.5 g of sodium 2-ethylhexyl sulfosuccinate, 4 g of tricresyl phosphate (TCP) and 20 ml of cyclohexanone was dissolved by heating. This solution was mixed with 100 g of a 10% aqueous solution of gelatin with stirring and the mixture was dispersed by means of a homogenizer at 10,000 rpm for 10 minutes, whereby a dispersion of dye providing substance was prepared.

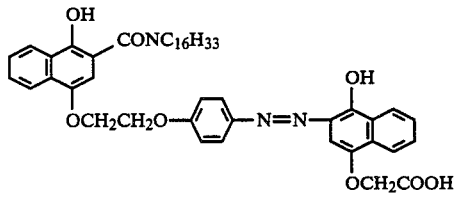

Light-Sensitive Material J was prepared in the same manner as described for Light-Sensitive Material A of Example 1 except using the above-described dispersion of dye providing substance in place of the dispersion of coupler and changing a wet layer thickness of a light-sensitive layer to 30 μm. Further, Light-Sensitive Material K was prepared in the same manner as described for Light-Sensitive Material J except using a comparative compound shown below in place of Compound (1) according to the present invention.

Comparative Compound:

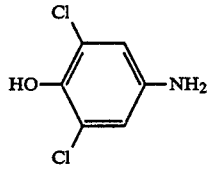

A method of preparing a dye fixing material is described in the following.

10 g of poly(methyl acrylate-co-N,N,N-trimethyl-N-vinylbenzylammonium chloride) (molar ratio of methyl acrylate to vinylbenzylammonium chloride was 1:1) was dissolved in 200 ml of water and then uniformly mixed with 100 g of a 10% aqueous solution of lime-processed gelatin. The resulting mixture was uniformly coated at a wet layer thickness of 90 μm on a paper support laminated with polyethylene with titanium dioxide dispersed therein. The thus-prepared material was dried and then used as a dye fixing material.

Light-Sensitive Materials J and K were each exposed imagewise for 10 seconds at 2,000 lux using a tungsten lamp and then uniformly heated for 20 seconds on a heat block which had been heated at 140° C.

The above-described dye fixing material was soaked in water and then superimposed on each of the above-heated Light-Sensitive Materials J and K in such a manner that their coated layers were in contact with each other.

After heating for 6 seconds on a heat block maintained at 80° C., the dye fixing material was separated from the light-sensitive material, whereupon a negative magenta color image was obtained in the dye fixing material.

The negative image was measured for its density to green light by means of a Macbeth reflective densitometer (RD-519). The results thus-obtained are shown in Table 3 below.

Further, Light-Sensitive Materials J and K were each allowed to stand at 25° C. for 1 week and then subjected to the same procedure as described above. The increase in fog density (A D min) was measured and the results are also shown in Table 3 below.

TABLE 3

| Light-Sensitive Material | Compound | D max | D min | A D min (after lapse of 1 week at 25° C.) |
|---|---|---|---|---|
| J | Compound (1) (Present Invention) | 2.00 | 0.24 | 0.25 |
| K | Comparative Compound | 2.10 | 0.36 | 1.80 |

From the results shown in Table 3, it is apparent that the comparative compound also adversely effect on the stability of the light-sensitive material in case of an image dye transfer system as shown in this example. In contrast, the compound according to the present invention provided an excellent effect on stability of the light-sensitive material.

EXAMPLE 4

Light-Sensitive Material L was prepared in the sama manner as described for Light-Sensitive Material A of Example 1 except using 10 g of a coupler shown below in place of the cyan coupler used in Light-Sensitive Material A and changing the wet layer thickness of a light-sensitive layer to 30 μm.

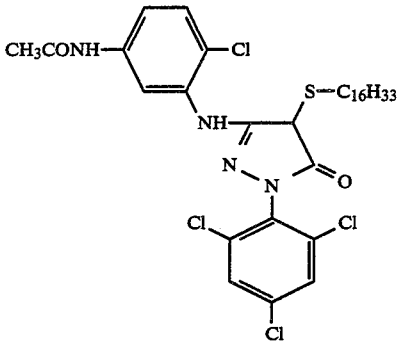

Further, Light-Sensitive Material M was prepared in the same manner as described for Light-Sensitive Material L except using a comparative compound shown below in place of Compound (1) according to the present invention.

Comparative Compound:

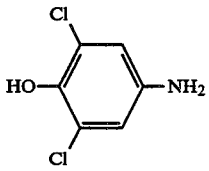

Light-Sensitive Materials L and M were each subjected to the same imagewise exposure and heating as described in Example 3. The same dye fixing material as described in Example 3 was soaked in a 0.5 M aqueous solution of sodium carbonate, then superimposed on each of the above-heated Light-Sensitive Materials L and M in such a manner that their coated layers were in contact with each other and heated for about 6 seconds on a heat block maintained at 80° C. After cooling, the dye fixing material was separated from the light-sensitive material, whereupon a negative magenta color image was obtained in the dye fixing material.

The density of the negative image and the increase in fog density (A D min) after allowing the light sensitive material to stand at 25° C. for 1 week were measured and the results thus-obtained are shown in Table 4 below.

TABLE 4

| Light-Sensitive Material | Compound | D max | D min | A D min (after lapse of 1 week at 25° C.) |
|---|---|---|---|---|
| L | Compound (1) (Present Invention) | 1.52 | 0.26 | 0.13 |
| M | Comparative Compound | 1.60 | 0.33 | 1.85 |

From the results shown in Table 4, it is apparent that the light-sensitive material in which the compound according to the present invention is used exhibits excellent stability during preservation thereof.

EXAMPLE 5

Light-Sensitive Material N was prepared in the same manner as described for Light-Sensitive Material J of Example 3 except using 10 g of the dye providing substance shown below in place of the dye providing substance used in Light-Sensitive Material J and changing the wet layer thickness of a light-sensitive layer to 60 μm.

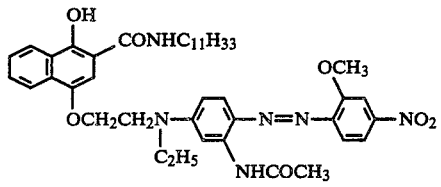

Further, Light-Sensitive Material O was prepared in the same manner as described for Light-Sensitive Material N except using the same comparative compound as shown in Example 3 in place of Compound (1) according to the present invention.

Light-Sensitive Materials N and O were each exposed imagewise for 10 seconds at 2,000 lux using a tungsten lamp and then heated for 60 seconds on a heat block which had been heated at 180° C. After cooling the light-sensitive material to room temperature, the coating on the polyethylene terephthalate film was mechanically peeled apart, whereupon a clear negative magenta image was obtained in the film.

The density of the negative image and the increase in fog density (A D min) after allowing the light sensitive material to stand at 25° C. for 1 week were measured and the results thus-obtained are shown in Table 5 below.

TABLE 5

| Light-Sensitive Material | Compound | D max | D min | A D min (after lapse of 1 week at 25° C.) |
|---|---|---|---|---|
| N | Compound (1) (Present Invention) | 1.35 | 0.65 | 0.12 |
| O | Comparative Compound | 1.40 | 0.20 | 1.15 |

From the results shown in Table 5, it is apparent that the light-sensitive material in which the compound according to the present invention is used is excellent in stability during preservation thereof in the case of a heat transfer system of hydrophobic dye as illustrated in this example.

While the invention has been described in detail and with reference to specific embodiments thereof, it will be apparent to one skilled in the art that various changes and modifications can be made therein without departing from the spirit and scope thereof.

What is claimed is:

1. A heat-developable color light-sensitive material comprising a support having thereon at least: (1) a light-sensitive silver halide, (2) a coupler capable of coupling with an oxidation product of a developing agent, (3) a hydrophilic binder, and (4) at least one compound represented by the following general formula (Z):

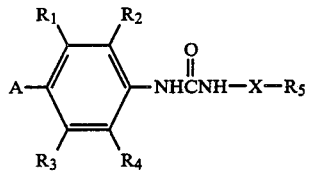

(Z)

wherein $R_1$, $R_2$, $R_3$ and $R_4$ each independently represents a hydrogen atom, a halogen atom, an alkyl group, an alkenyl group, a cycloalkyl group, an aralkyl group, a hydroxy group, an amino group, a substituted amino group, an alkoxy group, an acylamino group, an alkylsulfonylamino group, an arylsulfonylamino group, an aryl group, a carbamoyl group, a substituted carbamoyl group, a sulfamoyl group, a substituted sulfamoyl group, an acyl group, an acyloxy group or an alkoxycarbonyl group, or $R_1$ and $R_2$ or $R_3$ and $R_4$ are connected to each other to form a ring; A represents a hydroxy group, a group capable of providing a hydroxy group upon the function of a nucleophilic reagent or a group of

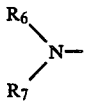

(wherein $R_6$ and $R_7$ each represents a hydrogen atom, a substituted or unsubstituted alkyl group, a substituted or unsubstituted alkenyl group, a substituted or unsubstituted cycloalkyl group or a substituted or unsubstituted aralkyl group, or $R_6$ and $R_7$ are connected to each other to form a hetero ring), or when A represents the group of

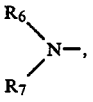

$R_1$ and $R_6$ and/or $R_3$ and $R_7$ are connected to each other to form a hetero ring; $R_5$ represents a substituted or unsubstituted alkyl group, a substituted or unsubstituted alkenyl group, a substituted or unsubstituted cycloalkyl group, a substituted or unsubstituted aralkyl group or a substituted or unsubstituted aryl group; and X represents a group of

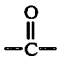

or a group of $—SO_2—$.

2. A heat-developable color high-sensitive material as claimed in claim 1, wherein the alkyl group or alkenyl group represented by $R_1$, $R_2$, $R_3$ or $R_4$ has from 1 to 32 carbon atoms.

3. A heat-developable color light-sensitive material as claimed in claim 1, wherein the cycloalkyl group represented by $R_1$, $R_2$, $R_3$ or $R_4$ has from 3 to 8 carbon atoms.

4. A heat-developable color light-sensitive material as claimed in claim 1, wherein the group represented by $R_1$, $R_2$, $R_3$, $R_4$ and $R_5$ is substituted with one or more substituents selected from the group consisting of an aliphatic group, an aryl group, a heterocyclic group, an aliphatic oxy group, an aromatic oxy group, an acyl group, an ester group, an amido group, an imido group, an aliphatic, aryl or heterocyclic sulfonyl group, an aliphatic, aryl or heterocyclic thio group, a hydroxy group, a cyano group, a carboxy group, a sulfo group and a nitro group.

5. A heat-developable color light-sensitive material as claimed in claim 1, wherein the nucelophilic reagent is an anionic reagent or a compound having a lone electron pair.

6. A heat-developable color light-sensitive material as claimed in claim 1, wherein A represents a hydroxy group, an acyloxy group, an alkylsulfonyloxy group, an arylsulfonyloxy group, an alkoxycarbonyloxy group, an aryloxycarbonyloxy group, a dialkylphosphoryloxy group, a diarylphosphoryloxy group, a dialkylamino group (the alkyl groups may be substituted), a pyrrolidino group, a piperidino group or a morpholino group.

7. A heat-developable color light-sensitive material as claimed in claim 1, wherein $R_1$, $R_2$, $R_3$ and $R_4$ each represents a hydrogen atom, a halogen atom, an alkyl group, an alkoxy group, an acylamino group, an aryl group, a carbamoyl group or a substituted carbamoyl group.

8. A heat-developable color light-sensitive material as claimed in claim 1, wherein $R_5$ represents an alkyl group, a cycloalkyl group, an aralkyl group or an aryl group.

9. A heat-developable color light-sensitive material as claimed in claim 1, wherein the coupler is an active methylene compound, an active methine compound, a phenyl, a naphthol, a pyrazole compound or a condensed pyrazole compound.

10. A heat-developable color light-sensitive material as claimed in claim 9, wherein the coupler is represented by the following general formulae (I) to (X):

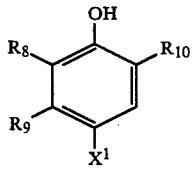

(I)

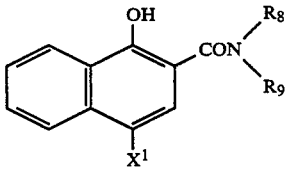

(II)

-continued

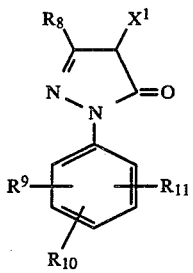

(III)

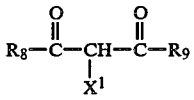

(IV)

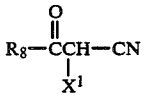

(V)

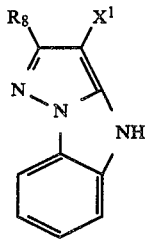

(VI)

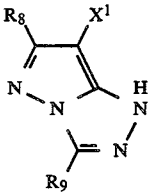

(VII)

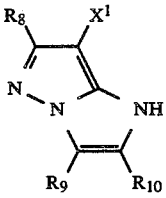

(VIII)

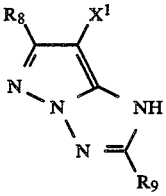

(IX)

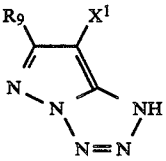

(X)

wherein $R_8$, $R_9$, $R_{10}$ and $R_{11}$ each represents a substituent selected from the group consisting of a hydrogen atom, a halogen atom, an alkyl group, a cycloalkyl group, an aralkyl group, an alkenyl group, an aryl group, an alkoxy group, an aryloxy group, an acyl group, an acylamino group, an alkoxyalkyl group, an aryloxyalkyl group, a carbamoyl group, a substituted carbamoyl group, a sulfamoyl group, a substituted sulfamoyl group, an alkylamino group, an arylamino group, an acyloxy group, an acyloxyalkyl group, a substituted ureido group, a cyano group and a heterocyclic group and these substituents may further be substituted with an alkyl group, an alkoxy group, a halogen atom, a hydroxy group, a carboxy group, a sulfo group, a cyano group, a nitro group, a carbamoyl group, a substituted carbamoyl group, a sulfamoyl group, a substituted sulfamoyl group, an acylamino group, an alkylsulfonylamino group, an arylsulfonylamino group, an aryl group, an aryloxy group, an aralkyl group or an acyl group; and $X^1$ represents a hydrogen atom or a coupling releasing group.

11. A heat-developable color light-sensitive material as claimed in claim 10, wherein the coupling releasing group represented by $X^1$ is a halogen atom, an acyloxy group, a sulfonyloxy group, an alkoxy group, an aryloxy group, an alkylthio group, an arylthio group, an alkoxycarbonyloxy group, a dialkylcarbamoyloxy group, an imido group, an N-heterocyclic group or a pyridinium group.

12. A heat-developable color light-sensitive material as claimed in claim 1, wherein the coupler is a dye-releasing coupler.

13. A heat-developable color light-sensitive material as claimed in claim 12, wherein the coupler is represented by the following general formula (XI):

$$\text{Coup—Link—Dye} \qquad \text{(XI)}$$

wheren Coup represents a coupler residue capable of coupling with an oxidation product of a developing agent; Link is connected to the active point of the coupler residue and represents a group having a bond connected to the coupler residue which bond is capable of being cleaved when the dye providing substance represented by the general formula (XI) is subjected to the coupling reaction with an oxidation product of a developing agent; and Dye represents a dye portion.

14. A heat-developable color light-sensitive material as claimed in claim 13, wherein Link is an azo group, an azoxy group, —O—, —Hg—, an alkylidene group, —S—, —S-S—or —$NHSO_2$—.

15. A heat-developable color light-sensitive material as claimed in claim 13, wherein Coup represents a phenol type coupler residue, a naphthol type coupler residue or an indanone type coupler residue and Link is connected to Coup through an oxygen atom or a nitrogen atom.

16. A heat-developable color light-sensitive material as claimed in claim 1, wherein an amount of the compound represented by the general formula (Z) is in a range from about 0.1 mol to about 10 mols per mol of the silver salt contained in the light-sensitive material.

* * * * *